United States Patent [19]

de Haan

[11] Patent Number: 4,595,353

[45] Date of Patent: Jun. 17, 1986

[54] BURNER WITH IGNITION DEVICE

[75] Inventor: Simon de Haan, The Hague, Netherlands

[73] Assignee: Shell Oil Company, Houston, Tex.

[21] Appl. No.: 725,074

[22] Filed: Apr. 19, 1985

[30] Foreign Application Priority Data

May 23, 1984 [GB] United Kingdom ..... 8413160

[51] Int. Cl.[4] ..... F23Q 7/06

[52] U.S. Cl. ..... 431/263; 110/263; 110/264; 431/79; 431/264

[58] Field of Search ..... 431/79, 263, 264, 266; 110/264, 263

[56] References Cited

U.S. PATENT DOCUMENTS

| | | | |
|---|---|---|---|
| 3,147,795 | 9/1964 | Livingston et al. | 431/263 X |
| 3,265,114 | 8/1966 | Childree | 431/263 X |
| 3,299,841 | 1/1967 | Hamker et al. | 431/79 X |
| 3,324,926 | 6/1967 | Jakobi | 431/79 X |
| 3,486,835 | 12/1969 | Grobe | 431/79 |
| 4,368,031 | 1/1983 | Chadshay | 431/79 |

*Primary Examiner*—Edward G. Favors

[57] ABSTRACT

An ignition burner for igniting fuel oxygen-containing gas mixture. The burner utilizes a central electrode and means for supplying the electrode with both a low velocity flow and a high velocity flow of combustible gases to the electrode to form a first flame. The first flame is surrounded by a plurality of nozzles that supply additional fuel and oxygen-containing gas to form a large ignition flame.

6 Claims, 3 Drawing Figures

BURNER WITH IGNITION DEVICE

BACKGROUND OF THE INVENTION

The present invention relates to a burner provided with an ignition device, which burner is particularly suitable for start-up operations. The invention relates more in particular to such a burner having a built-in ignition device in the form of an auxiliary burner, which is fed with gaseous fuel and air and which is electrically ignited.

For combusting heavy, difficult ignitable fuels, such as pulverized coal, it is common practice to generate a relatively small start-up flame using a fuel which is less likely to blow out and which is used for ignition of the main fuel flow. It is necessary to provide some means for igniting the start-up flame in turn and for maintaining it in a lighted condition during the ignition of the main fuel flow. If the combustion operation is to be carried out in a closed, confined and pressurized space, such as for example in coal gasification processes, the ignition is normally carried out in two steps. First an ignition flame is generated, which flame is used to ignite a gaseous or liquid fuel, thereby producing a second relatively large flame, which in its turn is used to ignite the main fuel flow. The above process for igniting a fuel flow in a pressurized combustion chamber is normally carried out by means of an ignition device and a separate start-up burner operating on gaseous or liquid fuel. The start-up burner is not only used for igniting the main fuel flow but also for pressurizing the combustion chamber before the main fuel is introduced. Prior to introduction of the main fuel flow the iginition device, normally formed by an electrically generated gas torch, and the start-up burner are to be carefully positioned with respect to one another and with respect to the main fuel flow direction. It will be understood that this is a relatively cumbersome operation, in particular since the ignition device and start-up burner are to be installed in openings through the refractory lined wall of a combustion chamber.

A further problem with separate ignition devices and start-up burners, occurs because the ignition devices may be easily damaged due to handling and/or exposure to the radiation in the combustion chamber. Normally, the ignition devices operate with electric sparks, which sparks may be issued from a spark plug in the upstream end of the device. Such a spark plug position is favorable from a point of view of protection against mechanical damage of the plug itself. It is, however, less advisable to have the spark plug arranged at the entry side of the ignition device in view of the thermal load of the device with this position of the spark plug. The whole device is subjected to the high temperature of the flame generated by the sparks emitted from the spark plug.

In order to overcome the above problems caused by the application of ignition devices and separate start-up burners it has been proposed to incorporate such an ignition device in the start-up burner, such that the ignition device is protected against thermal and mechanical shocks by the start-up burner. The known start-up burners with their own ignition devices are, however, quite complicated and cumbersome, the more since such burners should be further provided with appropriate flame detector means. An example of the combination of a burner provided with an ignition device is described in U.S. Pat. No. 4,333,405. In this apparatus the ignition device is substantially centrally arranged in a start-up burner. Although this device as described is a relatively simple construction, it should be noted that the device is not provided with flame detecting means essentially for controlling the operation of the burner. It should be understood that the ignition flame produced in the ignition device can be easily extinguished if the burner should, under these conditions, be interrupted in order to prevent an explosive mixture from collecting in the combustion chamber. The start-up and the operation of the ignition device and of the start-up burner should therefore continuously be monitored.

SUMMARY OF THE INVENTION

The object of the present invention is to provide a burner with an ignition device which is of a simple construction and provided with means enabling stable and accurate operation.

The burner with ignition device thereto comprises a substantially cylindrical housing, a tubular element having an open inboard end defining a flame port, said element being substantially concentrically located in the housing. A substantially annular front wall extends between the cylindrical housing and the tubular element with conduit means arranged in the space defined between the housing and the tubular element for separately supplying fuel and oxygen-containing gas to an outlet means arranged in the annular front wall. The burner further comprises means arranged in the tubular element near the open inboard end for generating sparks, the spark generating means being formed of an elongated electrode having an uninsulated outer endpart and being substantially concentrically arranged in the tubular element, thereby defining an annular space. A combustible gas mixture is supplied to the annular space with an annular space being provided with a baffle assembly upstream of and adjacent to the outer end of the electrode. The baffle assembly is provided with first passage means for issuing low velocity combustible mixture towards the electrode's outer endpart and second passage means for issuing high velocity combustible mixture towards the electrode's outer endpart. The burner is provided with means for flame detection adjacent the electrode.

During operation of the above burner according to the invention sparks are generated near the open front end of the burner, which sparks cause ignition of the combustible gas mixture passing through the annular space between the tubular wall and the elongated electrode. A pilot flame is so generated in the outer part of the burner, which is less thermally loaded than in prior ignition burners where the gas mixture is ignited in the upstream part of the burner. The proposed burner further provides a continuous ignition of the fuel introduced into a combustion chamber, as follows. Due to the provision of a passage for low velocity combustible mixture in the annular space between the tubular element and the electrode, a small and stable pilot flame is formed in the tubular element after spark emission via the electrode. This stable pilot flame in its turn maintains ignition of the high velocity combustible mixture flowing through the same annular space. On account of the small pilot flame generated with a low velocity combustible mixture, the ignition burner according to the invention is less sensitive to pressure fluctuations in the combustion chamber and remains stable. The flame emitted from the hollow part of the tubular element in its turn ignites the mixture of fuel and oxygen-containing gas issued via the outlet means in the annular front part. The resulting flame can now be used for ignition of a main burner operating on, for example, pulverized coal.

The electrode is not only used for igniting the combustible mixture passing through the annular space enclosed by the tubular element, but may also be used for detecting via ionization the flame generated in this annular space. If a flame is formed the electrode will be electrically charged.

According to the invention, the burner is provided with further flame detecting means so arranged that the ultimately generated flame outside the burner may be detected. This provision enables a separate control of the flame in the tubular element and the flame formed outside the burner. The main flame detector system is preferably based on detection of infrared radiation which is transmitted via optical fiber means. Such optical fiber means are compact and occupy a little space in the burner.

A further aspect of the present invention resides in the separate outlet means for oxygen-containing gas and fuel, so that during operation of the burner oxygen-containing gas and fuel are separately jetted into the combustion space outside the burner. According to this principle of fuel/oxygen injection flame flashback through the oxygen/ fuel supply means is avoided. If the burner is used in a high pressure environment the oxygen-containing gas and fuel are preferably supplied into the combustion chamber at sonic velocity in order to make the burner operation independent of the pressure prevailing in the combustion chamber.

BRIEF DESCRIPTION OF THE DRAWINGS

The invention will now be further described by way of example with reference to the accompanying drawings, in which.

DESCRIPTION OF PREFERRED EMBODIMENT

Figure 1:
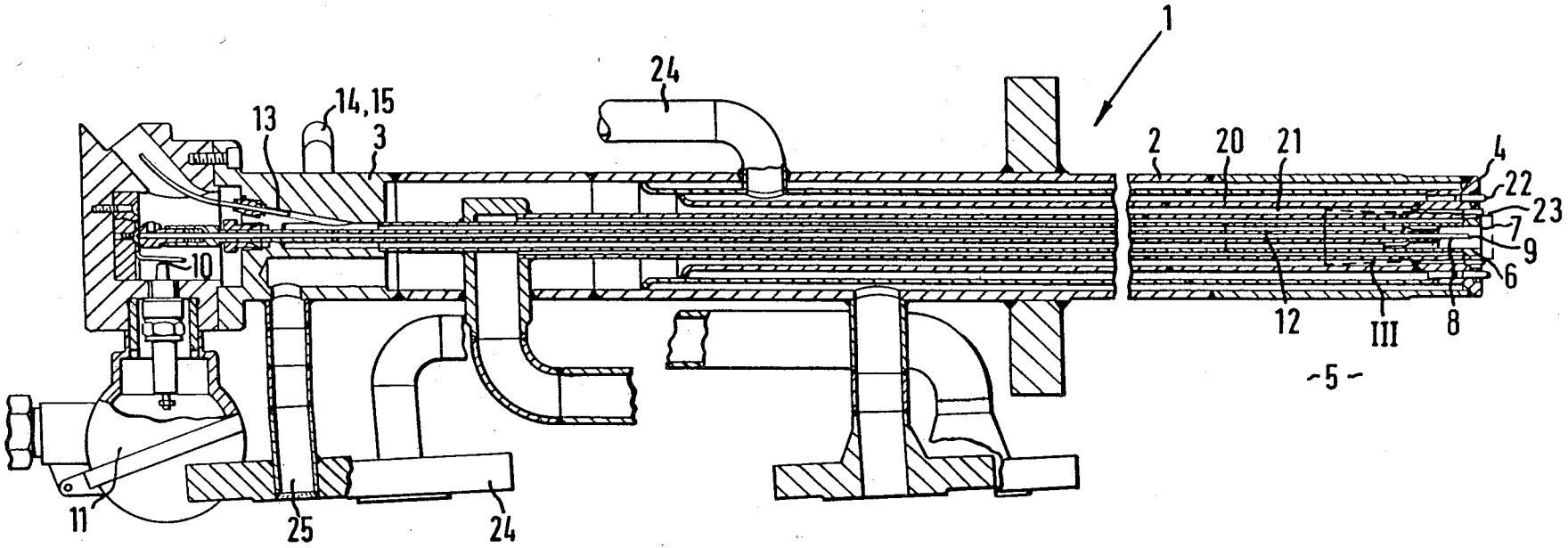
FIG. 1 shows an axial cross section of a burner according to the invention.
Figure 2:
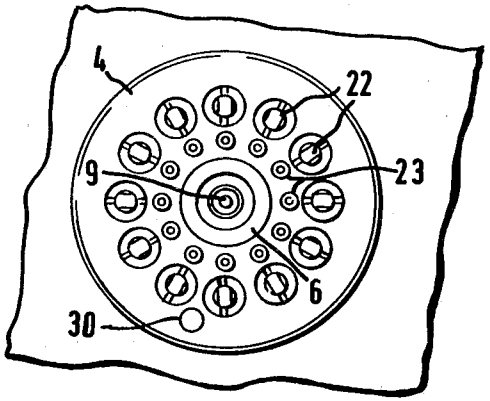
FIG. 2 shows front view of the burner shown in FIG. 1.
Figure 3:
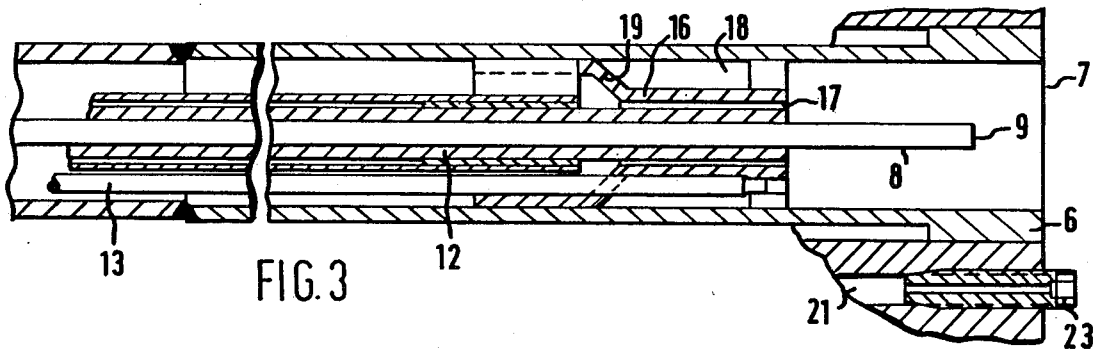
FIG. 3 shows detail III of FIG. 1 on a larger scale.

The shown burner, generally indicated with reference numeral 1 comprises a substantially cylindrical housing 2 with a closed outboard endpart 3 and an inboard end with an annular front wall 4 projecting into a combustion chamber 5. The annular front wall 4 extends between the housing 2 and a tubular element 6 arranged substantially coaxially with housing 2. The tubular element 6 has an open inboard end 7 defining a flame port. Within the tubular element 6 an elongated electrode 8 is arranged, having its front end 9 retracted from the inboard end 7 of element 6. The elongated electrode 8, which is substantially concentric with tubular element 6, is electrically connected to a spark generator 11 at its other end 10. Apart from its front endpart, the electrode 8 is covered with an annular layer 12 of insulating material, such as a ceramic material. Within tubular element 6 an optical fiber 13 (shown in FIG. 3) passing through a channel in the outboard endpart of the housing 2, is arranged. The optical fiber 13 is connectable to a receiver and transducer (not shown) for measuring the intensity of light emitted by the flame generated during operation of the burner.

For the supply of combustible mixture to the non-insulated endpart of electrode 8 the burner is provided with an inlet conduit 14 for fuel and an inlet conduit 15 for air. The inlet conduits 14 and 15 are preferably so arranged with respect to one another that an intimate mixture of fuel and air is formed in the tubular element 6. Near the front end 9 of electrode 8 the combustible mixture is split into two portions via a baffle assembly 16 provided with a substantially annular passage 17 for high velocity combustible mixture and a substantially annular passage 18 with a constricted supply passage 19 for low velocity combustible mixture.

The burner housing 2 is further provided with an annular conduit 20 for oxygen and an annular conduit 21 for fuel, both conduits being substantially concentrically arranged around the tubular element 6. The conduits 20 and 21 have their outer ends provided with nozzles 22 and 23, respectively, both nozzles 22 and 23 being substantially uniformly distributed over the adjoining conduits. Oxygen-containing gas and fuel are supplyable to the conduits 20 and 21 via inlet conduits 24 and 25, respectively. The spaces left between the various burner elements may be used for circulation of cooling medium through the burner housing.

For ignition of a main burner in a reactor in which for example, pulverized coal is used as combustion medium, the burner as described above is inserted into the reactor through, for example, an automatically operated system. After the burner has reached its operational position it is mechanically locked. If the combustion of the coal is to be carried out at elevated pressure, the reactor interior is first brought to the desired pressure. Apart from igniting the coal flow the start-up burner is also used for pressurizing the reactor to the required pressure before the coal is introduced into the reactor. The start-up burner is lit in two steps. First a small flame is generated in the tubular element of the burner by activation of the spark generator 11 causing the formation of sparks between the electrode 8 and the tubular element 6, causing the ignition of a gaseous combustible mixture being passed through the tubular element along electrode 8. The small flame will not become extinguished due to the formation of a small pilot flame in the tubular element by ignition of the low velocity mixture issued from the passage 18 in the baffle assembly 16. The flame from the tubular element 6 is then used for ignition of the fuel issued via the nozzles 23 of conduit 21, while oxygen-containing gas is supplied via the nozzles 22 of conduit 20. The flame generation in the tubular element 6 is inspected by controlling the presence of electrical currents in the electrode 8 generated via ionization upon flame formation in the tubular element 6. The flame formed in the reactor by the burner may be monitored by means of an infrared radiation detector 30 coupled to the optical fiber 13.

After the reactor has been brought to the required pressure and the start-up burner flame has been fully developed coal/oxygen jets are introduced into the reactor via the main coal burner and ignited.

It should be understood that the application of the proposed burner is not restricted to ignition of other burners. The proposed burner itself may also be operated as a main burner with its own ignition device.

What is claimed is:

1. An ignition burner for use in start-up operations comprising:

a cylindrical housing;

a tubular element, having one end open for defining a flame port and disposed concentrically within said housing;

an annular front wall, said annular front wall extending from the cylindrical housing to the tubular element, said annular front wall in addition having an outlet means for oxygen-containing gas and fuel;

conduit means, said conduit means being disposed in the space between the housing and tubular element to separately supply fuel and oxygen-containing gas to said outlet means in the annular front wall;

an elongated electrode disposed concentrically in said tubular element and having an uninsulated end adjacent said flame port;

means communicating with the annular space between said electrode and tubular member for supplying a combustible gas mixture to said annular space;

a baffle assembly disposed in said annular space adjacent the uninsulated end of the electrode, said baffle assembly having a first passage means for supplying a low velocity flow of said combustible gas mixture to the uninsulated end of said electrode, and a second passage means for supplying a high velocity flow of said combustible gas mixture to the uninsulated end of the electrode; and flame detector means disposed in said tubular member for detecting a flame present in said outlet means.

2. A burner as claimed in claim 1, wherein the flame detector means is formed by an optical fiber connectable to a light receiver.

3. A burner as claimed in claim 2, wherein said optical fiber is arranged in the interior of the tubular element.

4. A burner as claimed in claim 1, wherein the outlet means in the annular front wall is formed by a plurality of outlet nozzles, said nozzles being arranged in the annular front wall and being substantially uniformly distributed around the flame port.

5. A burner as claimed in claim 4, wherein the outlet nozzles comprise a first plurality of outlet nozzles for oxygen-containing gas and a second plurality of outlet nozzles for the fuel, both said first and second nozzles being arranged in the annular front wall and being substantially uniformly distributed around the flame port.

6. The burner as claimed in claim 1, wherein the first passage means is formed by a substantially annular passage and said second passage means is formed by a restricted substantially annular passage means.

* * * * *